US008511806B2

(12) United States Patent
Mattern et al.

(10) Patent No.: US 8,511,806 B2
(45) Date of Patent: Aug. 20, 2013

(54) SOLID INK LOADER WITH PULL-OUT DRAWER FOR INSERTION ACCESS

(75) Inventors: Frederick T. Mattern, Portland, OR (US); Danielle Renee Hall, Portland, OR (US); Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 314 days.

(21) Appl. No.: 12/905,672

(22) Filed: Oct. 15, 2010

(65) Prior Publication Data

US 2012/0092425 A1 Apr. 19, 2012

(51) Int. Cl.
*B41J 2/175* (2006.01)

(52) U.S. Cl.
USPC ..... 347/88; 347/84; 347/85; 347/99

(58) Field of Classification Search
USPC ..... 347/84, 85, 88, 99
See application file for complete search history.

(56) References Cited

U.S. PATENT DOCUMENTS

| | | | | |
|---|---|---|---|---|
| 5,861,903 | A | 1/1999 | Crawford et al. | |
| 6,010,214 | A * | 1/2000 | Sago et al. | 347/88 |
| 6,254,228 | B1 * | 7/2001 | Sago | 347/88 |
| 7,425,061 | B2 | 9/2008 | Korn et al. | |
| 7,726,798 | B2 | 6/2010 | Mattern et al. | |
| 8,210,671 | B2 * | 7/2012 | Mattern et al. | 347/88 |
| 8,240,830 | B2 * | 8/2012 | Jones et al. | 347/88 |
| 2009/0185016 | A1 * | 7/2009 | Jones | 347/88 |

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A phase change ink imaging device includes an ink loader operatively connected within a housing of the imaging device. At least a portion of the ink loader is configured to be withdrawn from the housing to enable ink stick insertion.

8 Claims, 10 Drawing Sheets

SOLID INK LOADER WITH PULL-OUT DRAWER FOR INSERTION ACCESS

TECHNICAL FIELD

This disclosure relates generally to phase change ink printers, and in particular to solid ink loaders for use in such printers.

BACKGROUND

Phase change ink imaging products encompass a wide variety of imaging devices, such as ink jet printers, facsimile machines, copiers, and the like, that are configured to utilize phase change ink to form images on recording media. Some of these devices use phase change ink in a solid form, referred to as solid ink sticks. Imaging devices that utilize solid ink sticks, sometimes referred to as solid ink printers, are typically provided with an ink loader having feed channels for receiving the solid ink sticks. Ink sticks are loaded into the channels through insertion openings. Each feed channel has an insertion region where ink sticks are received after passing through the insertion openings. Once an ink stick is received in the insertion region of a feed channel, the ink stick is urged by a spring-loaded push block toward a melting device located at an end of the channel, i.e., the melt end, where ink sticks are melted to a liquid ink suitable for jetting onto recording media. When multiple ink sticks are inserted into the channel, the ink sticks abut against each other in the channel to form a column of ink that extends between the melt end of the feed channel and the push block.

The ink loader of a solid ink printer is typically situated at or near the top of the printer architecture with the insertion openings for the feed channels reachable from above the printer. An access cover is positioned over the top of the ink loader to control access to the insertion openings as well as to prevent debris and other contaminants from entering the channels during operations. In some devices, the access cover is linked to the push blocks of the feed channels to retract the push blocks to positions behind the insertion regions so that ink sticks may be inserted into the channels in front of the push blocks. When the access cover is closed, the push blocks are moved forward through the insertion regions of the channels to push ink sticks received in the insertion regions toward the melt ends of the channels (and into contact with the trailing ends of the columns of ink therein if ink sticks are already present in the channels).

In devices that have an access cover positioned over the insertion openings, sufficient clearance must be provided be the access cover to be moved through its required range of motion to expose the insertion openings, and in some cases, to retract the push blocks to allow ink sticks to be inserted into the feed channels. Providing sufficient clearance for ink stick insertion and/or for an access cover's range of motion requires the ink loader to be positioned at or near the top surface of the printer. This requirement limits the arrangement and/or selection of printer components. More flexibility in the design and construction of printers is desirable.

SUMMARY

In accordance with the present disclosure, a phase change ink imaging device includes an ink loader operatively connected within a housing of the imaging device. At least a portion of the ink loader is configured to be withdrawn from the housing to enable ink stick insertion into the loader. In one embodiment, an ink loader includes a plurality of feed channels with at least a portion of each feed channel being configured to move with respect to the housing from a position within the housing to a position external to the housing. In another embodiment, an ink loader includes a movable portion configured to move with respect to the housing between a first position at which the feed paths of the ink loader lead to an ink melting device for melting solid ink and a second position at which insertion of solid ink into the feed channels is enabled.

DETAILED DESCRIPTION

Figure 1:
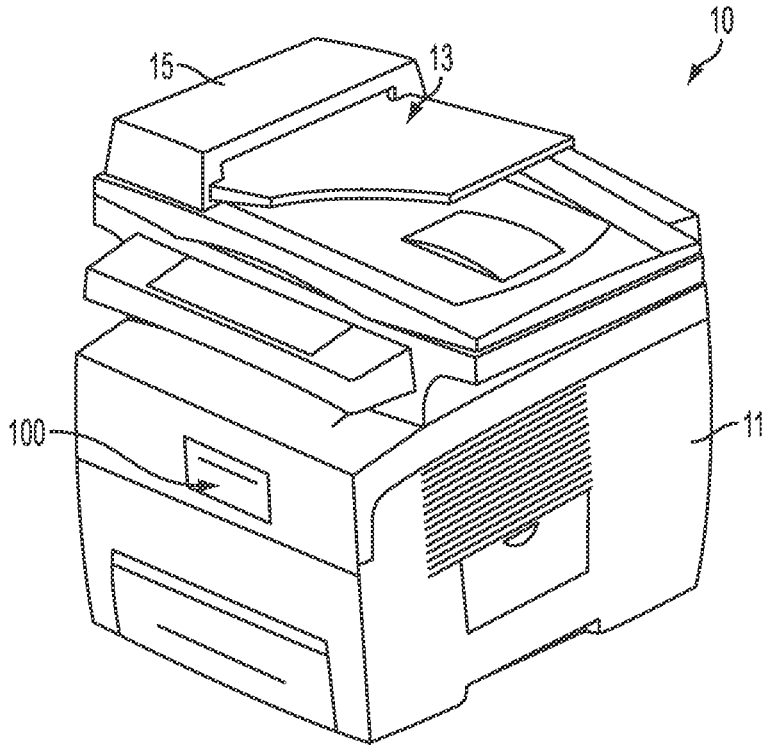
FIG. 1 is a perspective view of an embodiment of a phase change ink imaging device having a pull-out ink loader in the enclosed position.

For a general understanding of the present embodiments, reference is made to the drawings. In the drawings, like reference numerals have been used throughout to designate like elements.

Figure 2:
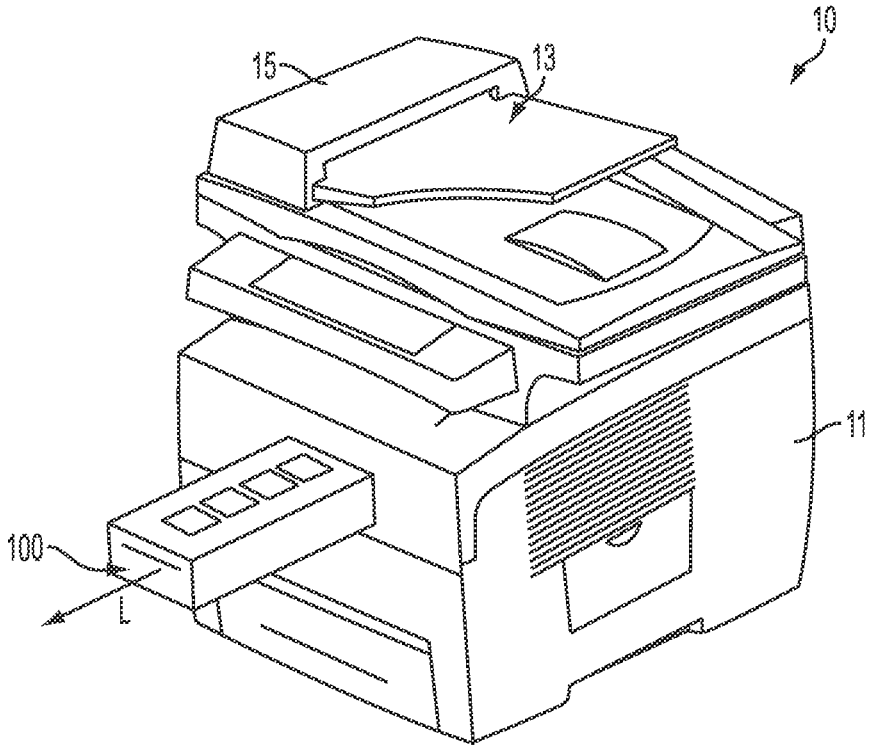
FIG. 2 is a perspective view of the phase change ink imaging device of FIG. 1 with the pull-out ink loader in the accessible position.
Figure 3:
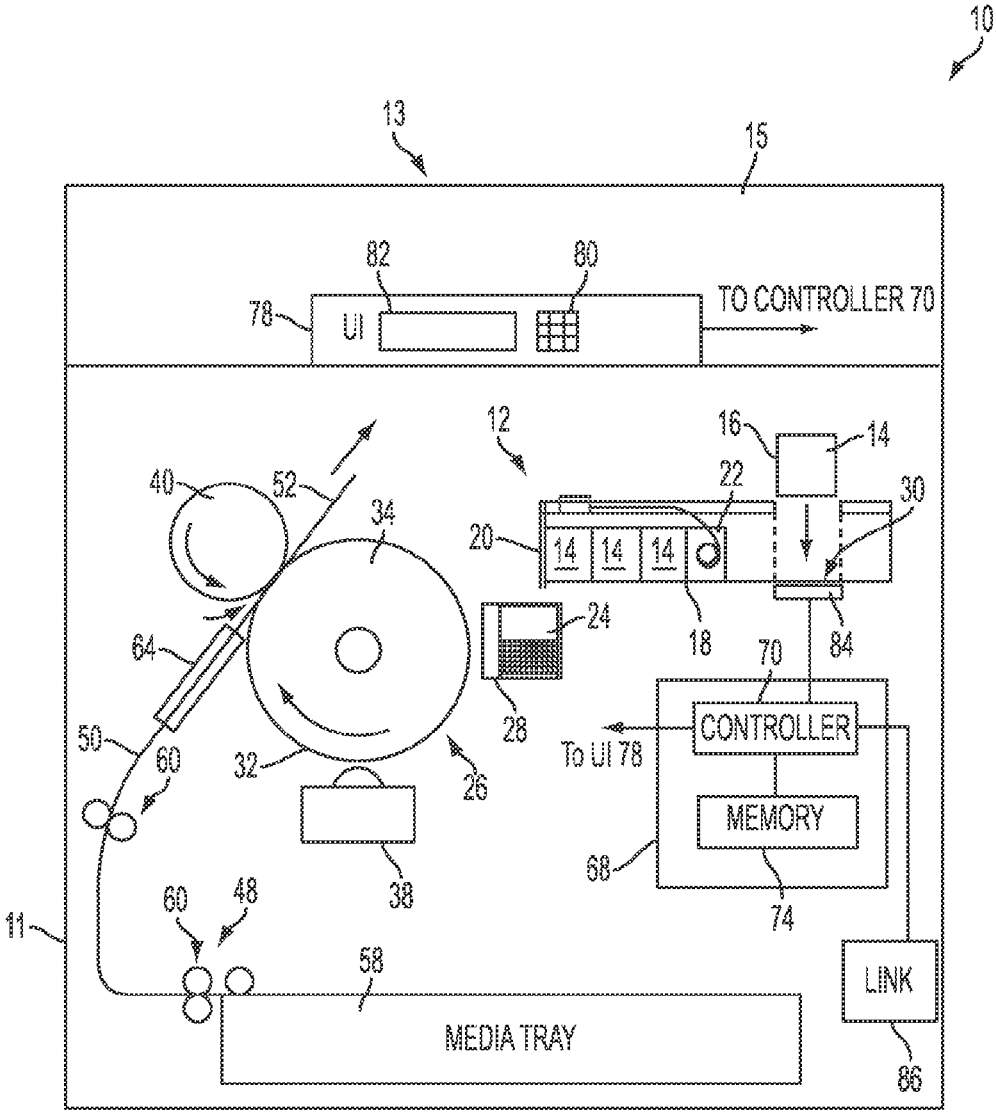
FIG. 3 is a schematic illustration of the systems of a phase change ink imaging device, such as the device of FIGS. 1 and 2.

The present disclosure is directed to a pull-out, drawer style ink loader for use with phase change ink imaging devices, such as the device 10 depicted in FIGS. 1-3. Multiple configurations may be encompassed by the pull-out ink loader architecture from a full ink loader pull-out configuration to a partial ink loader pull-out configuration that includes primarily the insertion region of the feed channels. The device 10 of FIGS. 1-3 comprises a multi-function peripheral (MFP) device although a pull-out ink loader in accordance with the present disclosure may be incorporated into numerous other phase change ink imaging device configurations, such as a printer, copier, fax machine, and the like.

As explained below, the device 10 includes an ink loader 12 (FIG. 3) having a pull-out, drawer-type component 100 that allows at least the insertion region, or section, of the ink loader 12 to be moved laterally with respect to the housing 11 of the device 10 from a substantially enclosed position within the housing 11 (FIG. 1) to an accessible position (FIG. 2) where the insertion openings 16 are accessible and ink stick insertion is enabled. The pull-out component 100 enables ink sticks 14 to be inserted into the ink loader 12 at a location offset from the top portion 13 of the device 10, such as in front of the device 10 as depicted in FIGS. 1 and 2. Offsetting the insertion region as shown enables other printer components and added functionality to be incorporated at the top of the printer, such as a scanner system 15 and associated media pathway. The pull-out ink loader 12 may also be beneficial in situations where clearance above the top portion 13 of the printer is limited.

FIG. 3 is a simplified schematic view showing the relationship between the ink loader 12 and the other systems and mechanisms of a phase change ink imaging device, such as the device 10. As depicted, the imaging device 10 has a housing 11 that supports and at least partially encloses the various systems and components of the device 10, including the ink loader 12, printing system 26, and media supply and handling system 48. Any suitable housing 11 and support system may be used depending on the configuration of the device 10, and, in particular, the arrangement, dimensions, and operational requirements of the device components.

The ink loader 12 is configured to receive phase change ink in its solid form as blocks of ink 14, referred to as solid ink sticks, and to deliver the ink sticks to a melting assembly 20 that melts the solid ink sticks to a liquid ink suitable for forming images on recording media. The ink loader 12 includes feed channels 18 into which the ink sticks 14 are inserted. Although a single feed channel 18 is visible in FIG. 3, the ink loader 12 includes a separate feed channel for each color or shade of ink stick 14 used in the device 10 (See, e.g., FIG. 7). Ink sticks 14 are inserted into an insertion region 30 of the feed channels through insertion openings 16. The insertion region 30 of a feed channel refers to the portion of the guide path of the feed channel where an ink stick comes to rest upon entry into the channel. In the embodiment of FIG. 3, the insertion openings 16 are positioned above the channels 18 so the insertion rest region 30 of the channel 18 corresponds to the portion of the channel 18 located substantially below the opening 16. In alternative embodiments, ink sticks 14 may be inserted into the channels through an opening in the side of the channels or the ends of the channels.

Once inserted into a feed channel 18, the ink sticks are urged toward the second end 96 of the feed channel and the melt device 20 by an ink stick feed mechanism. Any suitable feed mechanism may be utilized. In the embodiment of FIG. 3, the feed mechanism includes a spring-loaded push block 22 configured to apply an urging force to the ink sticks in the channel 18 that moves the ink sticks toward the second end 96. An ink stick 14 that arrives at the second end 96 is directed into contact with a melting device 20 that heats the stick to a phase change ink melting temperature. Any suitable melting temperature may be used depending on the phase change ink formulation. In one embodiment, the phase change ink melting temperature is approximately 80° C. to 130° C. As depicted in FIG. 3, the melted ink is received in a melt reservoir 24 for use by the printing system 26 of the device 10 during appropriate operation states.

The printing system 26 includes at least one printhead 28 having inkjets arranged to eject drops of melted ink onto an ink receiving surface. A single printhead 28 is depicted in FIG. 3. Any suitable number of printheads 28, however, may be used. The device 10 of FIG. 3 is configured to use an indirect printing process in which the drops of ink are ejected onto an intermediate surface 32 and then transferred to recording media, such as paper, transparency, and the like. In alternative embodiments, the device 10 may be configured to eject the drops of ink directly onto recording media. A layer or film of release agent is applied to a rotating member 34 by the release agent application assembly 38 to facilitate the transfer of ink images from the surface 32 of member 34 to the recording media. The rotating member 34 is shown as a drum in FIG. 3 although in alternative embodiments member 34 may comprise a rotating roller, moving belt or band or other similar type of structure. A transfix roller 40 is loaded against the intermediate surface 32 on rotating member 34 to form a nip 44 through which sheets of recording media 52 are fed in timed registration with the ink image on the intermediate surface 32. Pressure (and in some cases heat) is generated in the nip 44 that, in conjunction with the release agent applied to the intermediate surface 32 by applicator 38, facilitates the transfer of the ink drops from the surface 32 to the recording media 52 while substantially preventing the ink from adhering to the rotating member 34.

A media supply and handling system 48 transports recording media along a media path 50 defined in the device 10 that guides media through the nip 44. The media supply and handling system 48 includes at least one media source 58, such as supply tray 58 for storing and supplying recording media of different types and sizes for the device 10. The media supply and handling system includes suitable mechanisms, such as rollers 60, which may be driven or idle rollers, as well as baffles, deflectors, and the like, for transporting media along the media path 50.

Media conditioning devices may be positioned along the media path 50 for controlling and regulating the temperature of the recording media so that the media arrives at the nip 44 at a suitable temperature to receive the ink from the intermediate surface 32. For example, in the embodiment of FIG. 3, a preheating assembly 64 is provided along the media path 50 for bringing the recording media to an initial predetermined temperature prior to reaching the nip 44. The preheating assembly 64 may rely on contact, radiant, conductive, or convective heat, or any combination, to bring the media to a target preheat temperature, which in one practical embodiment, is in a range of about 30° C. to about 70° C. In alternative embodiments, other thermal conditioning devices may be used along the media path before, during, and after ink has been deposited onto the media for controlling media (and ink) temperatures and/or moisture content.

Operation and control of the various subsystems, components and functions of the imaging device 10 are performed with the aid of a control system 68. The control system 68 is operatively connected to receive and manage image data from one or more image sources, such as scanner system 15 or a communication link 86, and to generate control signals that correspond to the image data. These signals cause the components and systems to perform the various procedures and operations for the imaging device 10. The control system 68 includes a controller 70, electronic storage or memory 74, and a user interface (UI) 78. The controller 70 may comprise a processing device, such as a central processing unit (CPU), an application specific integrated circuit (ASIC), a field programmable gate array (FPGA) device, or microcontroller, configured to execute instructions stored in the memory 74. Any suitable type of memory or electronic storage may be used. For example, the memory 74 may be a non-volatile memory, such as read only memory (ROM), or a programmable non-volatile memory, such as EEPROM or flash memory.

The user interface (UI) 78 includes an input/output device that enables operator interaction with the control system 68. For example, UI 78 may include a keypad, buttons, or other similar types of manual actuators 80, and a display 82. The controller 70 is operatively connected to the user interface 78 to receive signals indicative of selections and other information input to the user interface 78 by a user or operator of the device and to display information to a user or operator including selectable options, machine status, consumable status, and the like. The controller 70 is coupled to a communication link 86, which may comprise a computer network, for receiving image data and user interaction data from remote locations.

The controller 70 is configured to generate control signals that are output to the various systems and components of the device 10, such as the ink handling system 12, printing system 26, media handing system 48, release agent application assembly 38, media conditioning devices 50, and other devices and mechanisms of the imaging device 10 in accordance with the print data and instructions stored in memory 74. The control signals, for example, control the operating speeds, power levels, timing, actuation, and other parameters, of the system components to cause the imaging device 10 to operate in various states, modes, or levels of operation, referred to as operating modes.

Figure 4A:
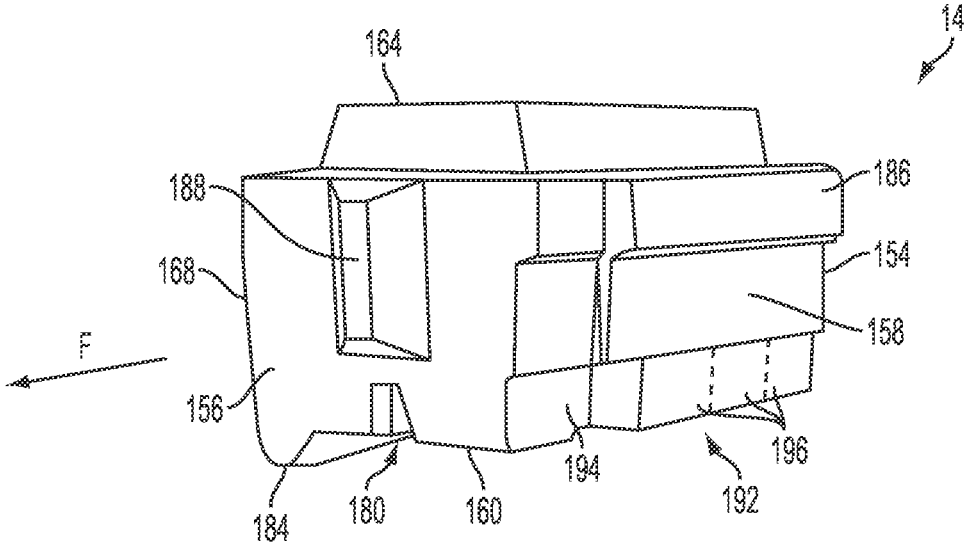
FIG. 4A is a perspective view of the leading end of a solid ink stick for use with the phase change ink imaging device of FIGS. 1-3.
Figure 4B:
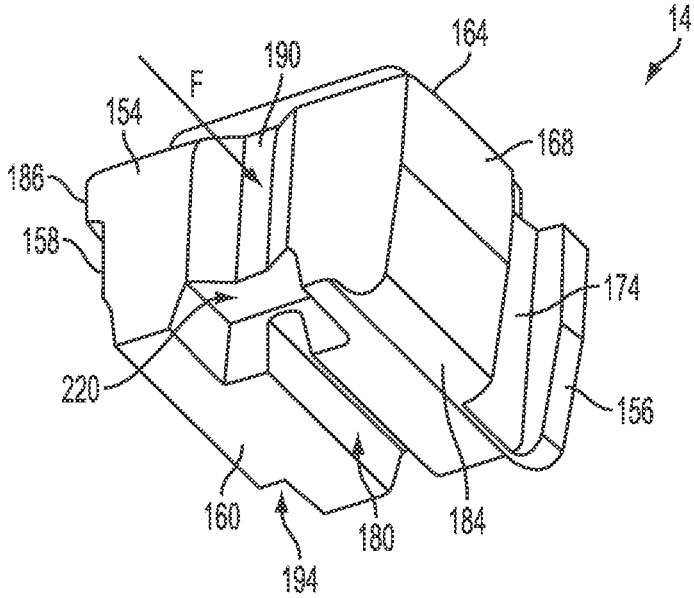
FIG. 4B is a perspective view of the trailing end and bottom surface of the ink stick of FIG. 4A.

Referring now to FIGS. 4A and 4B, a solid ink stick 14 comprises a body formed of a solidified phase change ink material and shaped using a suitable fabrication process, such as casting, pour molding, injection molding, compression molding, or other known techniques. The ink stick 14 includes a bottom surface 160 configured for arrangement adjacent to the base or floor of a feed channel 18, a top surface 164 opposite the bottom surface 160, a leading end surface 156 configured for arrangement in the feed channel 18 facing in the feed direction F, a trailing end surface 154 configured for arrangement facing opposite the feed direction, and lateral side surfaces 158, 168, and 186. Though ink sticks for different models may differ considerably in appearance or size, the ink stick 14 of FIGS. 4A and 4B is representative of surfaces and feature types that may be present on other ink sticks.

Ink sticks, such as ink stick 14 of FIGS. 4A and 4B, may include a number of surface features that aid in the correct loading, guidance, feed control and support of the ink stick when used. As used herein, the term "surface features" and "features" used in relation to ink sticks refers to topological contours, such as protrusions, recesses, grooves, and the like, that are sized, shaped, and/or otherwise configured to interact in some manner with one or more elements, devices, and members of an ink loader, or feed channel, such as key elements, guides, supports, sensors, etc. For example, the ink stick 14 includes insertion key feature 174 that comprises a groove or notch formed in side surface 168 extending generally between the top surface 164 and the bottom surface 160. The ink loader 12 includes a keyplate 80 (FIG. 7) having insertion openings 16 through which ink sticks are inserted into the feed channels 18. Each insertion opening 16 has a perimeter that is shaped complementary to the perimeter shape of ink sticks that are for use with the corresponding feed channel 18.

An ink stick may also include feed control and guidance features for interacting with various structures provided in the feed channel. For example, ink stick 14 includes a feed key groove 180 formed in the bottom surface 160 extending from the leading end surface 156 to the trailing end surface 154. The feed key groove 180 is configured to straddle a feed key (not shown) that extends from the feed channel. In addition, the ink stick 14 includes a protruding guide feature 184 near the bottom of side surface 168 and a protruding guide feature 186 near the top of side surface 158 for interacting with complementary structures in the feed channel to facilitate alignment of ink sticks in the channel and to limit contact between ink sticks and the feed channel structural elements, such as ribs, supports and other potentially restrictive surfaces. In embodiments, an ink stick may be provided with any suitable type of feed key and/or guide feature for interacting in any manner with whatever type of keying, guidance or support members are provided in a feed channel.

An ink stick may also include nesting features (although not necessarily) to facilitate alignment and feed guidance of the ink sticks in the feed channels. As depicted in FIGS. 4A and 4B, the ink stick 14 includes nesting features 188, 190 at the leading end 156 and trailing end 154, respectively, of the ink stick. The nesting features 188, 190 are shaped complementary with respect to each other which facilitates alignment between adjacent ink sticks while maximizing load density in the feed channel. In use, when an ink stick having a nesting feature 188 in the leading surface 156 abuts an ink stick in the feed channel having complementary nesting feature 190 in the trailing surface 154, the protruding nesting feature of one ink stick is received in the recessed nesting feature of the subsequent stick. The nesting features of the adjacent sticks cooperate to limit lateral movement of the sticks with respect to each other thereby promoting alignment of the sticks in the channel. When utilized, nesting features incorporated into the leading and trailing end of an ink stick may have any suitable configuration, including non-matching shapes and contours, that facilitate alignment and feed guidance of adjacent ink sticks in a feed channel.

In addition to or as an alternative to the insertion, feed guidance, and nesting features, ink sticks may be provided with sensor features for conveying ink stick data to the print controller of the solid ink printer. The ink stick data encoded onto an ink stick may include identification information, such as color, formulation, and intended printer model, as well as printing information, such as printer settings or preferences for use with the ink stick. Sensor features comprise surface formations on the ink stick body that are configured to interact with sensors positioned at one or more locations in the insertion region and/or other portions of feed channels to convey ink stick data to the print controller of a solid ink printer.

Sensor features may be incorporated into any surface or multiple surfaces of an ink stick and may have any suitable configuration that permits reliable sensor interaction, such as protrusions, recesses, reflective features, non-reflective features, and the like, depending on the type of sensor used. As best seen in FIG. 4A, the ink stick 14 includes a sensor feature 192 that comprises one or more contiguous insets 194 arrayed substantially parallel to the feed direction F in a lower portion of the side surface 158. A single inset 194 is shown in FIG. 4. The locations 196 shown as dotted lines represent other positions where insets may be placed in the exemplary embodiment. Inset sensor actuating features may be an inset and may extend through other surfaces of the ink stick body. For example, the inset 194 of FIG. 4A extends through the leading surface 156 as well as the bottom surface 160. When provided, an inset located near the trailing end of the ink stick may extend through the trailing surface 154.

Ink stick data may be encoded into a sensor feature of an ink stick by assigning data to be indicated by the sensor feature. To extract the data from the sensor feature 192, the feed channel 18 may be provided with a sensor system 84

(See, e.g., FIGS. 3 and 5) capable of sensing, detecting, or being actuated by the particular configuration of sensor feature utilized in an ink sticks. A sensor feature 192 actuates the sensors of the sensor system 84 causing the sensor system to output signals to the printer controller 70 indicative of the data assigned to the sensor feature 192. The controller 70 may then use the data to influence operations of the printer. For example, in one embodiment, once the ink stick data has been identified, the controller 70 may determine whether or not the ink stick is compatible with the printer and may provide user information and/or enable or disable operations accordingly.

Figure 5:
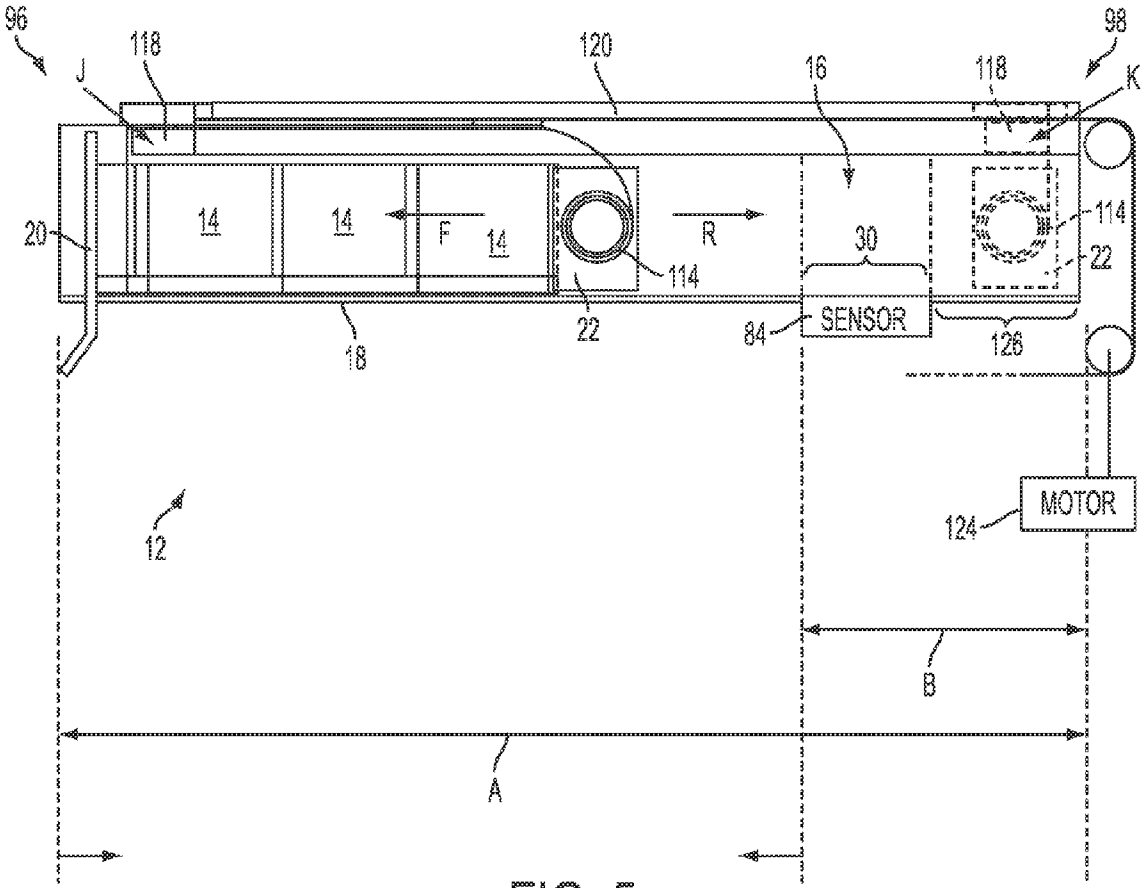
FIG. 5 is side cross-sectional view of a feed channel of the ink loader of FIGS. 1-3.

FIG. 5 depicts a side cross-sectional view of an ink loader 12 showing a feed channel 18 in greater detail. As shown, the feed channel 18 comprises a longitudinal chute or similar type of structure having a first end 98 and a second end 96. A melting device 20 in the form of a melt plate is located at the second end 96, also referred to as the melt end, of the channel 18. The longitudinal portion of the channel 18 extends between the first end 98 and the second end 96. The insertion region 30 is located at a suitable location between the first end 98 and second end 96 of the channel proximate the insertion opening 16. The term longitudinal, as applicable to an ink loader, refers to its lengthwise shape complementary to feed direction rather than widthwise in a direction across feed channels. The longitudinal portions of the feed channels may be straight, horizontal, vertical, sloped, arcuate or any combination thereof.

Each feed channel 18 includes a feed mechanism for urging ink sticks in the feed direction F toward the melting device 20 located at the melt end 96 of the channel. In the embodiment of FIGS. 3 and 5, the feed mechanism comprises a push block 22 that is configured for translational movement in the feed channel 18 between an urging position and at least one retracted position. As used herein, the term "push block" refers to any type of structure or mechanism capable of applying a motive or urging force to the ink sticks in the channel to cause the ink sticks to move in the feed direction F of the channel. In the urging position, the push block 22 is moved into contact with a trailing ink stick 14 in the feed channel by the drive system to apply a suitable force to urge the ink sticks in the feed direction F toward the melt device 20.

The melt device 20 has been described as being associated with the ink loader such that only molten ink would be exiting the loader after being melted during normal operation. The melt end of the ink loader feed channel typically includes a melting assembly but the melt function may be a device not integrated with the ink loader. Descriptions of or similar to "melt end" are applicable to the ink loader and/or feed direction even when the melting means is independent or implemented in an arrangement other than as depicted in FIGS. 3 and 5 and otherwise described herein. One alternative example to the present configuration is a loader where the ink exit end is configured to direct solidified ink forms, which may be a small size, to another device where it would be melted, one example being a melt reservoir of a printhead.

In the embodiment of FIG. 5, the urging force is provided by a constant force spring 114 which is wound at one end as a freely rotatable coil housed within the push block 22. The other end of the spring 114 is attached to a yoke 118. The yoke 118 is configured to move adjacent to the feed channel 18 between a forward position J proximate the melt end 96 of the feed channel 18 and a rearward position K proximate the first end 98 of the feed channel. The yoke 118 may be supported for movement between the forward and rearward positions in any suitable manner. For example, in the embodiment of FIG. 5, the yoke 118 is configured to cooperate with a guide slot and/or guide rail 120 arranged adjacent to the feed channel 18 to enable translational movement of the yoke 118 between the forward and rearward positions J,K.

The yoke 118 is coupled to an actuation system 124 that is configured to move the yoke 118 between the forward and rearward positions J, K to enable ink loading operations. Any suitable type of actuation system may be used such as a motorized actuation system as depicted in FIG. 5 although manually operated actuation or a combination of manual and electro-mechanical actuation may be used. A motorized actuation system 124 may be activated in any suitable manner such as by input received from the user interface 78 and/or by control signals received from the device controller 70. In embodiments, the controller 70 may be configured to control the actuation system 124 to enable ink loading based on user input as well as other factors, such as device operating state.

When the yoke 118 is in the forward position J, the constant force spring 114 pulls the push block 22 toward the melt end 96 of the channel. If ink sticks are positioned in the feed channel 18 in front of the push block 22, the pulling force of spring 114 on the push block 22 causes the push block 22 to move into contact with the trailing ink stick in the channel and apply an urging force toward the melt end 96 of the channel 18. In the embodiment of FIG. 5, the spring 114 is coupled to the hub of the push block 22 in a manner that enables the spring body to extend between the yoke 118 and the push block 22 without interfering with ink stick movement in the feed channel. For example, the spring body extends along a path that is located above the feed path of ink sticks in the feed channel. In embodiments, the spring 114 may extend along a path to either lateral side of the feed channel or below the feed channel.

The push block 22 is moved to a retracted position beyond the insertion region 30 of the channel to enable ink sticks to be inserted into the feed channel in front of the push block. To move the push block 22 to the retracted position in the embodiment of FIG. 5, the yoke 118 is moved from the forward position J to the rearward position K. Movement of the yoke 118 to the rearward position K allows the spring 114 to coil within the push block 22 which enables the yoke to move the push block 22 in the retraction direction R without encumbrance. As depicted, the feed channel 18 includes a rearward region 126 located between the insertion region 30 and the first end 98 to accommodate the retracted push block 22.

In embodiments, the ink loader 12 may be equipped with an ink stick retraction system (not shown) that enables one or more ink sticks to be retracted in conjunction with the push block 22 to ensure that the insertion region 30 is clear to receive ink. For example, an ink stick retractor mechanism (now shown) may be integrated into the push block 22 or the yoke 118 that is configured to catch, pull, push, drag, lift, or otherwise move one or more ink sticks in response to movement of the push block 22 and/or yoke 118 in the retraction direction R. The rearward region 114 may be sized to accommodate any suitable number of ink sticks in addition to the push block 22. An ink stick retraction system may also be driven and/or controlled independently of the feed components of the ink feed system. The ability to translate ink sticks into a retracted or staging position enables the insertion regions 30 of the channels to be located at an intermediate location of the feed channel without decreasing or limiting the number of ink sticks that may be loaded into the channel.

As depicted in FIGS. 1 and 2, the ink loader 12 includes a pull-out component 100 comprising at least the insertion region 30 of each feed channel 18 of the ink loader 12. The pull-out component 100 is movably supported within the housing 11 of the device 10 for lateral movement (i.e., in direction L) with respect to the feed direction F between an enclosed position (FIG. 1) and an accessible, or load, position (FIG. 2). When the pull-out component 100 is enclosed in the housing 11 of the device 10 as depicted in FIG. 1, the feed paths defined by the feed channels 18 are aligned with the melt devices 20 and melt ink reservoirs 24 thereby providing substantially continuous ink channels from the ink loader 12 to the printing system 26. When the pull-out component 100 is withdrawn from the housing 11 to the load position, the insertion openings 16 and the insertion region 30 of each feed channel 18 are laterally offset from the ink channels to a position where the insertion openings 16 are accessible for inserting ink sticks, such as the exterior of the housing 11. The pull-out component 100 may be configured for manual or powered actuation for movement between the enclosed and load positions. Ink melt and liquefied ink delivery to the printheads may be different than described, one example is an intermediate reservoir where molten ink is pumped to the printheads.

With reference to FIG. 5, multiple configurations may be encompassed by the pull-out ink loader architecture. For example, in embodiments, the pull-out component 100 of the ink loader 12 may comprise substantially the entire length of each feed channel 18 from the first end 98 to the second end 96 as indicated by arrow A, a partial length of each feed channel including primarily the insertion region 30 (and rearward region 126) as indicated by arrow B, or any number of intermediate partial lengths of each feed channel other than the full length (arrow A) and partial length (arrow B). The specific length of a full feed channel or width of the pull-out region and its capacity relative to the full feed channel capacity are application dependent. The pull-out region need not include space for a retracted push block or retracted ink stick(s). Printer product size and desired or permitted ink loader volumes differ between products, as do the ink stick sizes, aspect ratios and general shapes, all of which influence the ink loader configuration. Each possible pull-out loader configuration may have advantages and disadvantages relative to the other configurations with respect to the different printer architectures. Functions and aesthetics of the external surfaces and enclosure, as well as placement of the control panel, display and/or similar user interfaces, are also factors that may be taken into consideration in determining the configuration of the pull-out ink loader.

Figure 6:
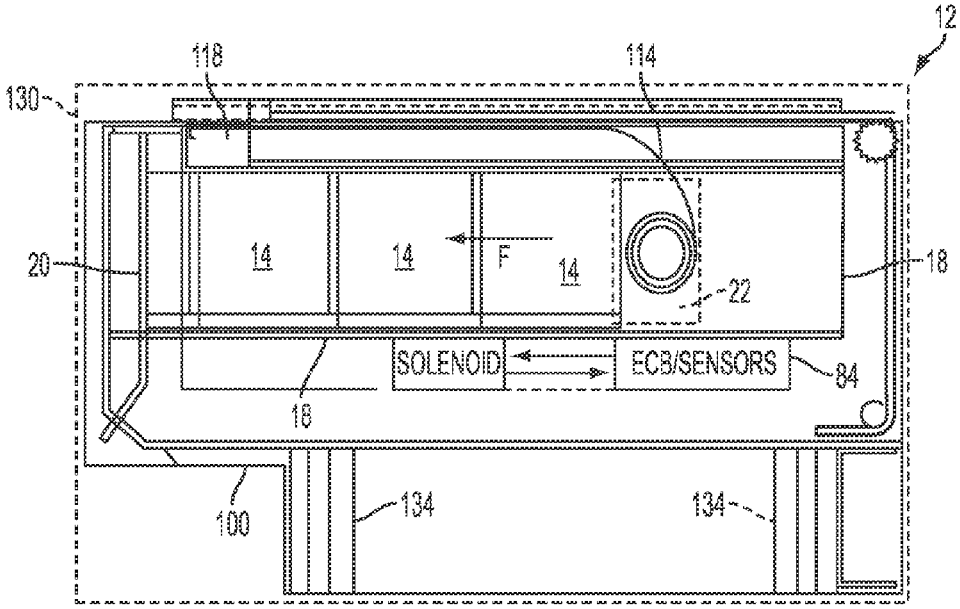
FIG. 6 is a side view of an embodiment of a pull-out ink loader comprising the full length of the feed channels.
Figure 7:
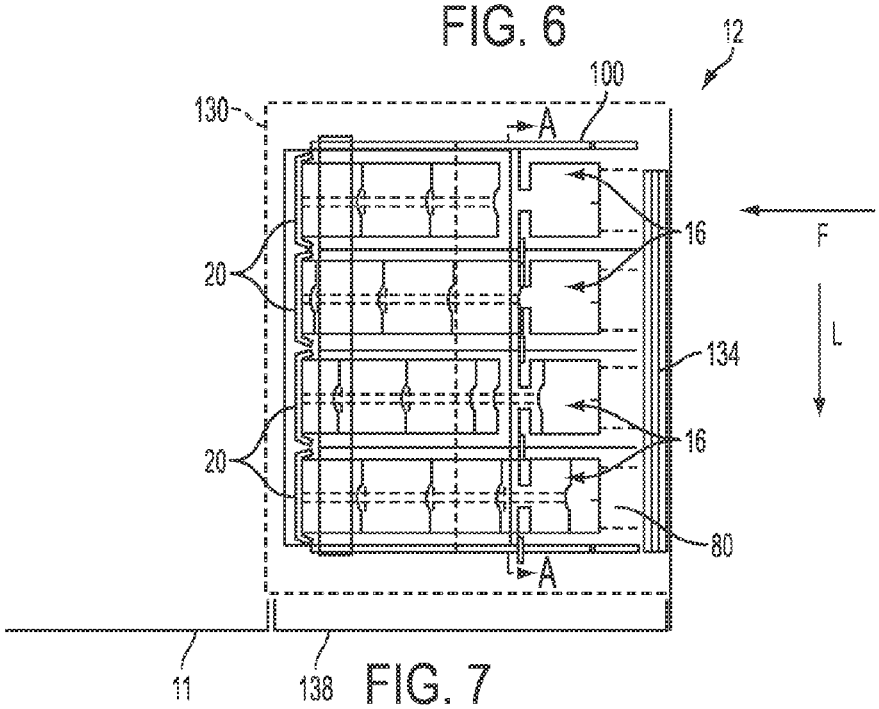
FIG. 7 is a top view of the pull-out ink loader of FIG. 6 in an enclosed position within the housing of the device of FIGS. 1-3
Figure 8:
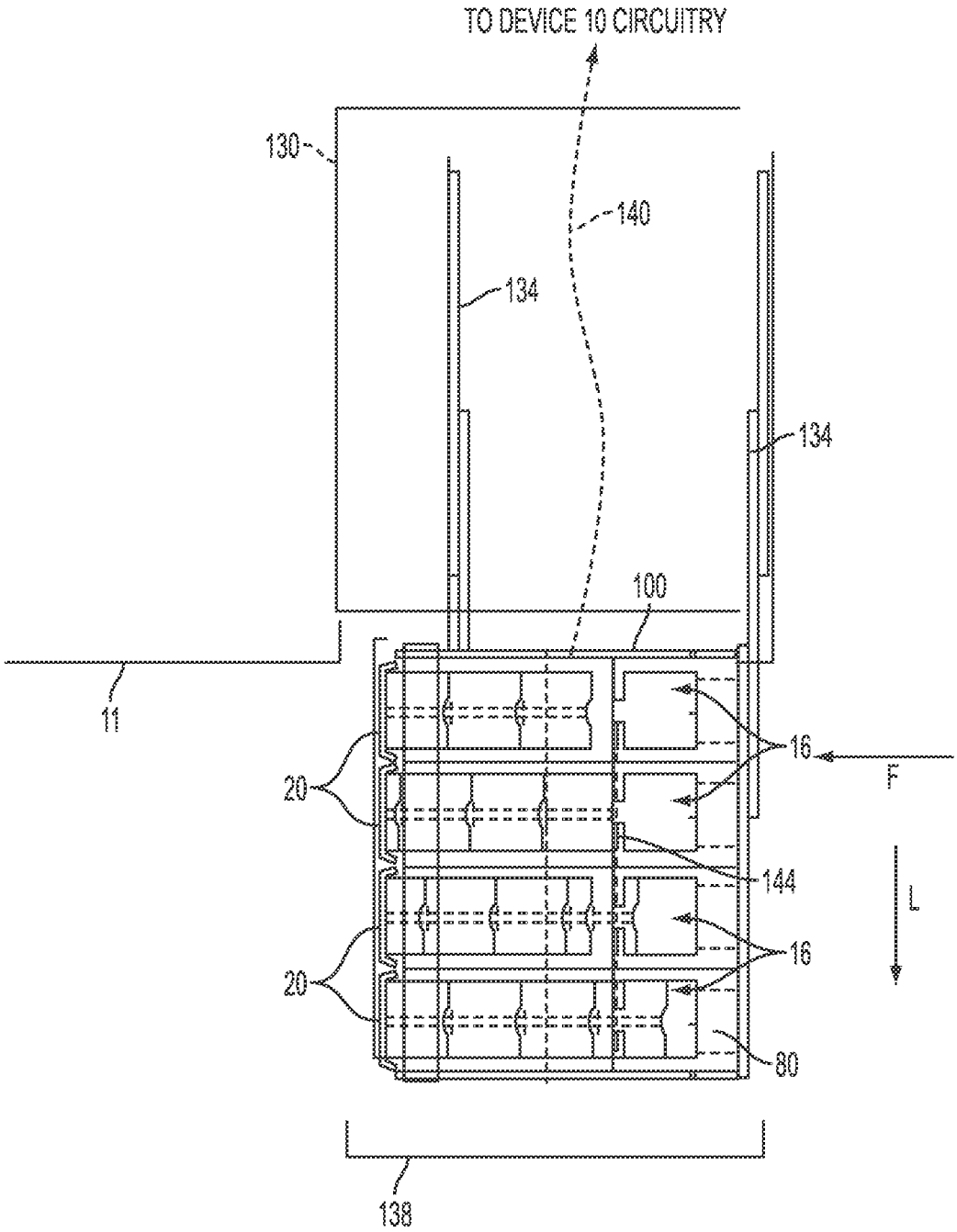
FIG. 8 is a top view of the pull-out ink loader of FIG. 6 in a load position withdrawn from the housing of the device of FIGS. 1-3

FIGS. 6-8 depict an embodiment of an ink loader having a pull-out component 100 that encompasses substantially the full ink loader 12, referred to herein as a pull-out ink loader. Accordingly, in the embodiment of FIGS. 6-8, the pull-out ink loader 100 is provided as unitary assembly that includes most if not all of the devices and mechanisms of the ink loader constructed in a suitable manner that enables the ink loader 12 to be movably supported within the housing 11 of the device 10. A space or area 130 is provided at an appropriate location within the housing 11 for receiving the pull-out loader 100 so that it may be aligned with the fixed components of the device 10, such as the printing system 26 and the melted ink handling components, such as the melt reservoir 24. A mounting system 134 couples the pull-out loader 100 to the device 10 to enable the movement of the pull-out loader 100 into and out of the space 130 in generally the lateral direction L. In the embodiment of FIGS. 6-8, the mounting system 134 comprises a slide system although the any suitable mounting system or method may be used. Movement between the enclosed and load positions may include multiple directions of linear and non-linear motion that result in the pull-out component and the insertion openings 16 being laterally offset from the housing 11 of the device 10. As seen in FIGS. 7 and 8, the pull-out loader 100 may include an outer panel 138 that aligns with the housing 11 when the pull-out loader 100 is in the enclosed position (FIG. 7) and that moves with the pull-out loader to the load position (FIG. 8). In alternative embodiments, the panel 138 may comprise an access cover that is opened to enable the pull-out loader 100 to be withdrawn from the housing 11.

In the embodiment of FIGS. 6-8, the melt devices 20 are incorporated into the pull-out loader 100 although in other embodiments the melt devices 20 may be configured to remain in a fixed position in the housing 11 when the pull-out loader 100 is moved with respect to the housing 11. Because the full length of the feed channels are being withdrawn with the pull-out loader 100, clearing the insertion region 30 does not have to be accomplished prior to withdrawing the pull-out component 100 from the housing 11. As depicted in FIG. 8, power and communication signal extension cabling and connections 140 may be provided for connecting the pull-out ink loader 100 to the power and communication circuitry of the device 10 while allowing the pull-out loader 100 to be moved from the enclosed position to the load position. In other embodiments, the pull-out loader 100 and the device 10 may be provided with a connect/disconnect system, such as mating sockets or connectors, that is configured to interconnect to provide power and communication when the pull-out loader 100 is moved into the enclosed position and that disconnects when the pull-out loader is withdrawn.

Figure 9:
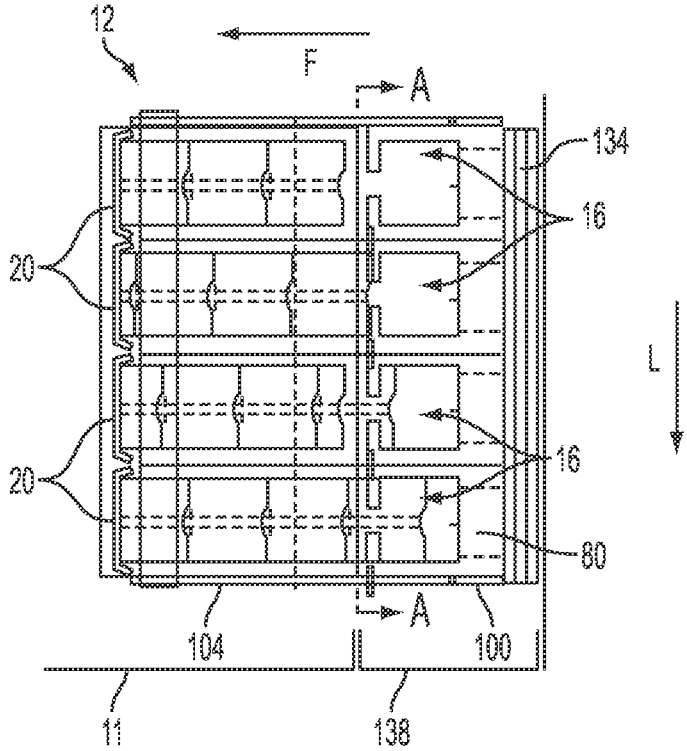
FIG. 9 is a top view of an embodiment of a pull-out component of an ink loader comprising a partial length of the feed channels of the ink loader including the insertion region 30 with the pull-out component in the enclosed position.
Figure 10:
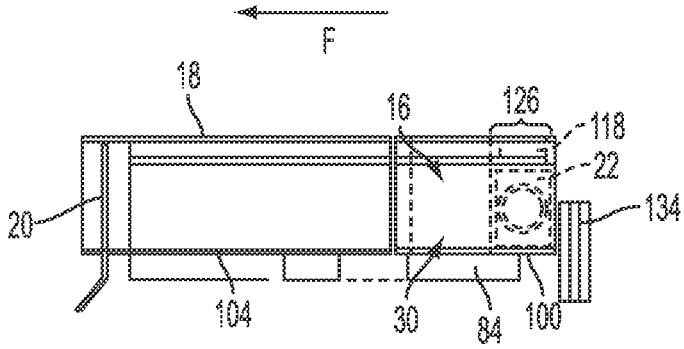
FIG. 10 is a side view of the ink loader of FIG. 9.
Figure 11:
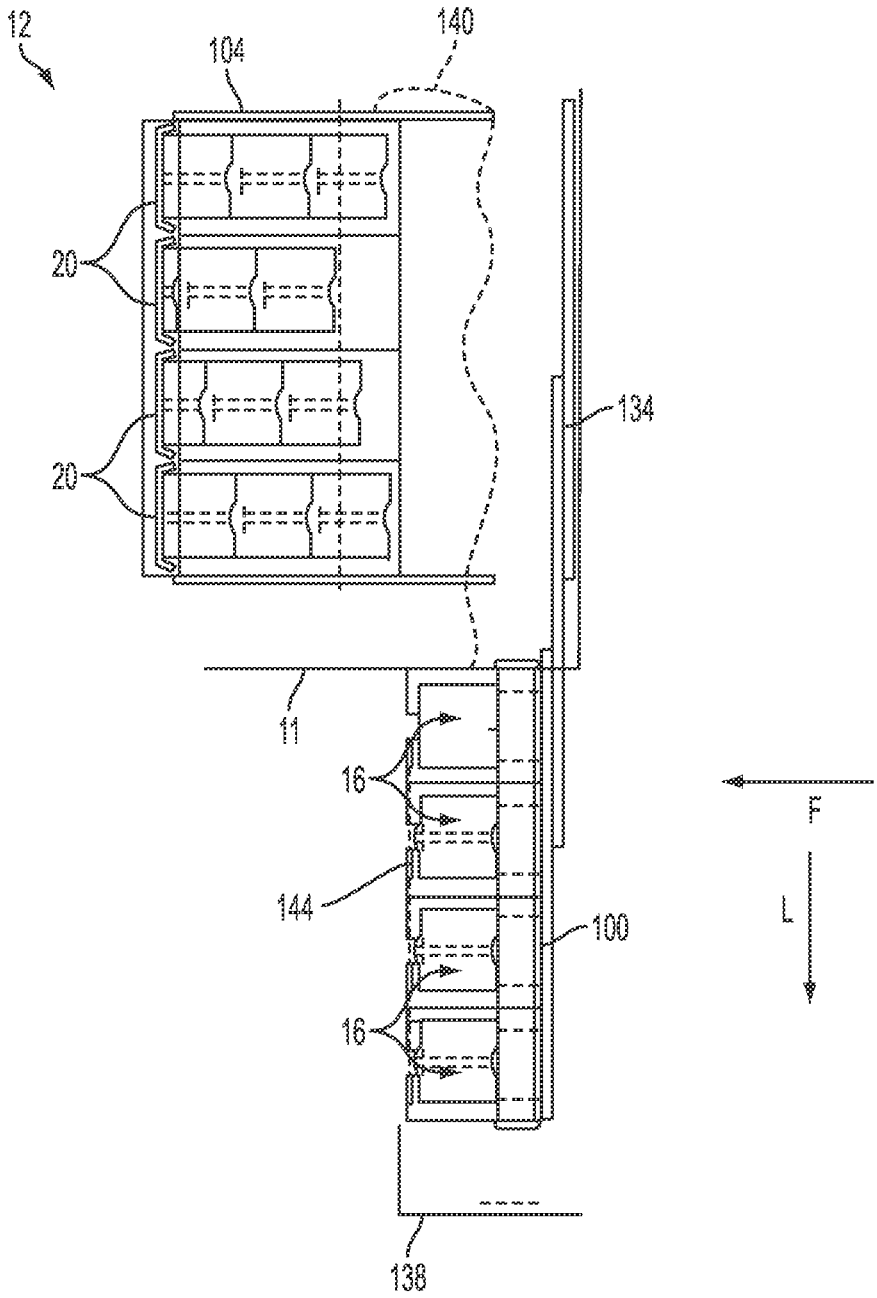
FIG. 11 is top view of the ink loader of FIG. 9 with the pull-out component in the load position.

FIGS. 9-11 depict an embodiment of a pull-out component 100' that comprises a partial length of the ink loader 12 including primarily the insertion region's 30 (and rearward region's 126) of each feed channel 18. The remaining portion 104 of the ink loader, i.e., from the insertion region to the melt device 20 is fixed in the housing 11 of the device 10 and thus is configured to remain within the housing 11 when the pull-out component 100' is withdrawn. Similar to the embodiment of FIGS. 6-9, the pull-out component 100' includes a mounting system 134, such as a slide mechanism, that mounts the pull-out component 100' to the device to enable the movement of the pull-out component 100' into and out of the housing 11 in generally the lateral direction L. In addition, the pull-out component 100' may include an outer panel 138 that aligns with the housing 11 when the pull-out component 100' is in the enclosed position (FIG. 9) and that moves with the pull-out loader to the load position (FIG. 11).

In the embodiment of FIGS. 9-11, the electronic and electro-mechanical devices and connections of the ink loader may be configured to remain fixed in the housing 11 when the pull-out component 100' is withdrawn. For example, the sensor system 84 may be configured to remain in place during withdrawal of the insertion region 30 of the pull-out component 100'. Alternatively, the sensor system 84 may be incorporated into the pull-out component 100' so that it is withdrawn with the insertion region 30. Similar to the embodiment of FIGS. 6-8, cabling 140 (FIG. 11) may be extended between the sensor system 84 (located beneath the insertion region 30 in FIG. 11) and the circuitry of the device 10, or the sensor system 84 and the device 10 may be provided with a connect/disconnect system (not shown) that is configured to interconnect to provide power and communication when the pull-out component 100' is moved into the enclosed position and that disconnects when the pull-out loader 100' is withdrawn.

As best seen in FIG. 10, the push blocks 22 are retracted to the rearward region 126 of the feed channels 18 prior to allowing the pull-out component 100' to be withdrawn from the housing 11. Ink sticks that are located in the insertion region 30 when the pull-out component 100' is ready for withdrawal may be left in the insertion region to indicate that the feed channel is at capacity. In alternative embodiments, one or more ink sticks may also be moved to the rearward region 126 (in embodiments that include an ink stick retraction system) in order to clear the insertion regions 30 for inserting ink sticks prior to withdrawal from the housing.

Figure 12:
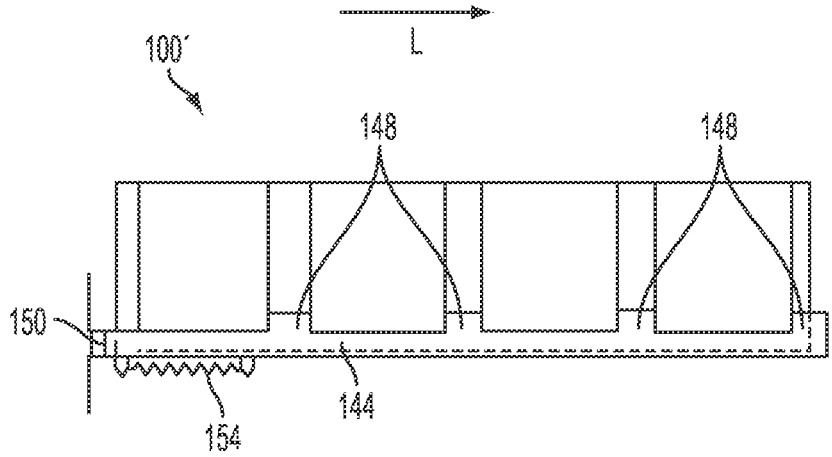
FIG. 12 shows an ink retainer for use with the pull-out component of FIGS. 9-11 with the retainer in the clear position.
Figure 13:
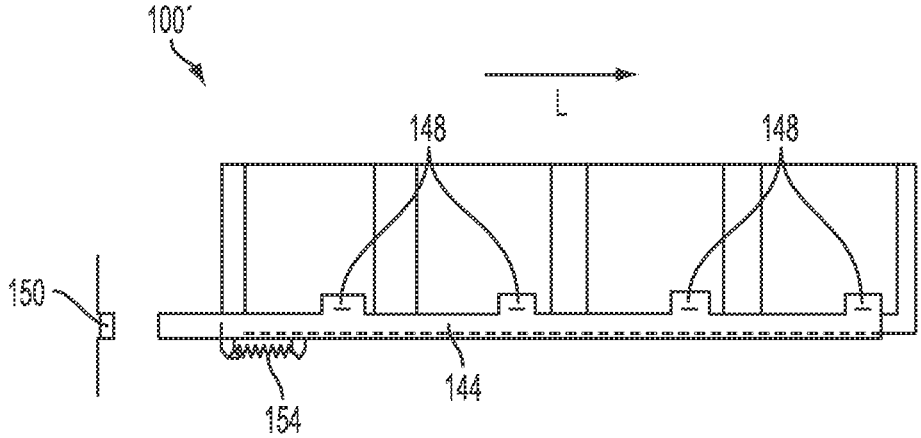
FIG. 13 shows the ink retainer of FIG. 12 in a retaining position.

The pull-out component 100' may also include an ink stick retaining member 144 that is configured to provide a barrier at the open end of the insertion region 30 of the pull-out component 100' to prevent ink sticks 14 from overlapping the boundary between the pull-out component 100' and the fixed portion 104 of the ink loader 12 as well as to prevent ink sticks from falling out of the open ends of the insertion region of the feed channels when the pull-out component is withdrawn. An embodiment of a retaining member 144 is depicted in FIGS. 12 and 13. As depicted, the retaining member 144 includes a barrier portion 148 for each feed channel 18 of the ink loader. In the embodiment of FIGS. 12 and 13, the retaining member 144 is configured to translate between a clear position (FIG. 12) at which the barriers 148 do not block the feed paths between the insertion regions 30 and the fixed portion 104 of the feed channels and a retaining position (FIG. 13) at which the barriers 148 are positioned to block ink stick movement from the insertion regions 30 of the pull-out component 100'. The retaining member 144 is configured to be in the clear position when the pull-out component 100' is enclosed in the housing 11, and is configured to move to the retaining position prior to or during withdrawal of the pull-out component 100' from the housing 11. The retaining member 144 may be moved between the clear and retaining positions in any suitable manner. For example, the retaining member 144 may be biased into the retaining position by a spring 154, or similar type of device. When the pull-out component 100' is in the enclosed position, an internal structure, surface, or mechanism 150 of the device 10 may be positioned to engage the retaining member 144 to move it into the clear position as depicted in FIG. 12. When the pull-out component 100' is withdrawn, the retaining member is free to move to the retaining position as depicted in FIG. 13.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those of ordinary skill in the art, which are also intended to be encompassed by the following claims.

What is claimed is:

1. A phase change ink imaging device comprising:

an ink jet imaging apparatus configured to emit drops of melted phase change ink;

a phase change ink melt system configured to melt phase change ink and deliver the melted ink to the inkjet imaging apparatus;

a housing that operatively supports and encloses the ink jet imaging apparatus and the phase change ink melt system;

an ink loader operatively connected within the housing, the ink loader having a plurality of feed channels, each feed channel defining a feed path along which ink sticks are moved in a feed direction toward the melt device, at least a portion of each feed channel being configured to move with respect to the housing between (i) a first position at which the feed channel is located within the housing, and (ii) a second position at which at least a portion of at least one feed channel is external to the housing to enable solid ink to be inserted into the at least one feed channel, each feed channel has an insertion region positioned within the portion of the feed channel configured to move between the first and the second positions and the movable portion of each feed channel includes a portion of the feed path defined by the feed channel that is less than the entire length of the feed path and an ink retainer configured to move to a retaining position at which movement of solid ink from the insertion region is inhibited and a clear position at which solid ink movement from the insertion region is enabled, the ink retainer being configured for movement to the retaining position when the movable portion of the ink loader is away from the first position and to the clear position when the movable portion is at the second position.

2. The device of claim 1, the movable portion of each feed channel being configured for movement substantially perpendicular to a portion of the feed path defined by the feed channel.

3. The device of claim 1, wherein the movable portion of each feed channel includes a phase change ink melt device of the phase change ink melt system.

4. The device of claim 1, the ink loader further comprising:

a solid ink transport system configured to urge ink sticks in the feed direction.

5. The device of claim 4, wherein the solid ink transport system is configured to move ink sticks from the insertion region of each feed channel in a retraction direction that is opposite the feed direction.

6. The device of claim 5, wherein each feed channel includes an area configured to receive solid ink moved from the insertion region in the retraction direction.

7. The device of claim 6, further comprising:

a sensor system configured to identify solid ink sticks inserted into the insertion region of each feed channel of the ink loader, the sensor system being configured to move with the movable portion of the ink loader.

8. The device of claim 6, further comprising:

a sensor system configured to identify solid ink sticks inserted into the insertion region of each feed channel of the ink loader, the movable portion of each feed channel being configured to move with respect to the sensor system.

* * * * *